US010626760B2

(12) United States Patent
Yamakawa et al.

(10) Patent No.: US 10,626,760 B2
(45) Date of Patent: Apr. 21, 2020

(54) VALVE OPENING/CLOSING TIMING CONTROL DEVICE

(71) Applicant: AISIN SEIKI KABUSHIKI KAISHA, Kariya-shi, Aichi-ken (JP)

(72) Inventors: Yoshiaki Yamakawa, Novi, MI (US); Masaki Kobayashi, Okazaki (JP); Yusuke Hisaeda, Kariya (JP)

(73) Assignee: AISIN SEIKI KABUSHIKI KAISHA, Kariya-shi, Aichi-ken (JP)

( * ) Notice: Subject to any disclaimer, the term of this patent is extended or adjusted under 35 U.S.C. 154(b) by 227 days.

(21) Appl. No.: 15/826,133

(22) Filed: Nov. 29, 2017

(65) Prior Publication Data

US 2018/0156080 A1 Jun. 7, 2018

(30) Foreign Application Priority Data

Dec. 2, 2016 (JP) ..... 2016-235222

(51) Int. Cl.
*F01L 1/34* (2006.01)
*F01L 1/344* (2006.01)

(52) U.S. Cl.
CPC ..... *F01L 1/3442* (2013.01); *F01L 2001/3443* (2013.01); *F01L 2001/3444* (2013.01);
(Continued)

(58) Field of Classification Search
CPC ..... F01L 1/3442; F01L 2001/3443; F01L 2001/34433; F01L 2001/3444;
(Continued)

(56) References Cited

U.S. PATENT DOCUMENTS 5,657,725 A * 8/1997 Butterfield ..... F01L 1/3442 123/90.17
9,708,939 B2 7/2017 Kobayashi et al.
(Continued)

FOREIGN PATENT DOCUMENTS

JP 2015-78635 A 4/2015
JP 2016-89664 A 5/2016

OTHER PUBLICATIONS

U.S. Appl. No. 15/825,980, filed Nov. 29, 2017, Yoshiaki Yamakawa et al.

*Primary Examiner* — Zelalem Eshete
(74) *Attorney, Agent, or Firm* — Buchanan Ingersoll & Rooney PC

(57) ABSTRACT

A valve opening/closing timing control device includes: a driving side rotator synchronously rotating with a crankshaft of an internal combustion engine; a driven side rotator coaxially disposed with a rotation axis of the driving side rotator and integrally rotating with a valve opening/closing camshaft; advance and retard chambers formed between the driving side and driven side rotators; a lock mechanism including a lock member capable of engaging with a recessed portion on one of the driving side and driven side rotators and provided in the other of the driving side and driven side rotators; and a connecting bolt coaxially disposed with the rotation axis and connecting the driven side rotator to the camshaft. The connecting bolt includes an internal space, and an advance port, a retard port and a lock port are formed as through-holes, a valve unit accommodates a spool, and the spool includes an internal flow path.

8 Claims, 11 Drawing Sheets

(52) U.S. Cl.
CPC ..... *F01L 2001/34426* (2013.01); *F01L 2001/34433* (2013.01); *F01L 2001/34453* (2013.01); *F01L 2001/34463* (2013.01); *F01L 2001/34466* (2013.01); *F01L 2001/34473* (2013.01); *F01L 2250/02* (2013.01)

(58) Field of Classification Search
CPC ... F01L 2001/34463; F01L 2001/34466; F01L 2001/34473; F01L 2001/34426; F01L 2001/34453; F01L 2250/02
See application file for complete search history.

(56) References Cited

U.S. PATENT DOCUMENTS

| | | | | |
|---|---|---|---|---|
| 2011/0303169 | A1* | 12/2011 | Nakamura | F01L 1/3442 123/90.15 |
| 2017/0234174 | A1 | 8/2017 | Yamakawa et al. | |

* cited by examiner

| | PA1 | PA2 | PN | PB2 | PB1 |
|---|---|---|---|---|---|
| ADVANCE CHAMBER | SUPPLY | SUPPLY | INTERRUPT | DISCHARGE | DISCHARGE |
| RETARD CHAMBER | DISCHARGE | DISCHARGE | INTERRUPT | SUPPLY | SUPPLY |
| LOCK MEMBER | DISCHARGE | SUPPLY | SUPPLY | SUPPLY | DISCHARGE |

VALVE OPENING/CLOSING TIMING CONTROL DEVICE

CROSS REFERENCE TO RELATED APPLICATIONS

This application is based on and claims priority under 35 U.S.C. § 119 to Japanese Patent Application 2016-235222, filed on Dec. 2, 2016, the entire contents of which are incorporated herein by reference.

TECHNICAL FIELD

This disclosure relates to a valve opening/closing timing control device which controls a relative rotation phase between a driving side rotator and a driven side rotator by a fluid pressure and holds the relative rotation phase at a predetermined phase by a lock mechanism.

BACKGROUND DISCUSSION

As the above-described valve opening/closing timing control device, JP 2015-78635A (Reference 1) discloses a technology in which a spool is coaxially disposed with a rotation axis, a relative rotation phase is controlled in an advance direction and a retard direction by operating the spool in a direction along the rotation axis, and thus, a lock mechanism is shifted to a locked state by setting the spool to an operation end in the advance direction and an operation end in the retard direction.

In Reference 1, a drain flow path (a main discharge flow path in Reference 1) is formed inside the spool and a fluid discharged from an advance flow path and a retard flow path and a fluid discharged from the lock mechanism are discharged from the drain flow path.

As described in Reference 1, the single spool is coaxially provided with the rotation axis of the valve opening/closing timing control device and the fluid is discharged from the drain flow path inside the spool. Accordingly, for example, in a case where the fluid is supplied to an advance chamber by operating the spool and the state is shifted to the locked state, the fluid flows from a retard chamber to the drain flow path and the fluid from an unlocking flow path flows to the drain flow path.

In Reference 1, the drain flow path having a relatively large flow path cross-sectional area is provided inside the spool. However, even when the drain flow path having a large diameter is provided, in a case where the drain of the drain flow path cannot catch up drainage capacity, a pressure in the drain flow path increases. In addition, the valve opening/closing timing control device and the spool rotate at a high speed during an operation of an internal combustion engine, and thus, in the drain flow path, the fluid is pressed to an inner peripheral wall of the spool by a centrifugal force and the pressure of the fluid in the drain flow path increases. Accordingly, in the configuration in which the unlocking flow path is combined to the drain flow path, the flow of the combined fluid is obstructed, and as a result, unlocking cannot be appropriately performed.

Particularly, when a fluid is supplied to the advance chamber, a pressure acts on a fluid discharged from the retard chamber according to the supply, but only a pressure caused by an urging force of a spring applied to a lock member acts on the fluid discharged from a lock flow path during locking. Accordingly, the pressure decreases during discharging of the fluid, and in a case where the flow of the fluid is obstructed, shifting of the lock mechanism to the locked state may not be appropriately performed.

Here, difficulty of shifting to the locked state peculiar to an intermediate lock will be described. For example, in the most retarded lock or the most advanced lock, lock shifting can be performed in a state where a vane abuts on a wall portion and a phase stops. Compared to this configuration, in a configuration which includes a lock phase other than the most advance phase or the most retard phase, when the state is shifted to a locked state, it is required to be rapidly shifted to the locked state when a lock member and a lock recessed portion reach a phase capable of engaging with each other in a situation where the lock member and the lock recessed portion are always displaced relative to each other. Accordingly, from this reason, the shifting to the locked state is difficult.

This disadvantage is remarkable in a case where, in a configuration in which engine oil is used as a fluid in a vehicle, the temperature of the fluid is low and the viscosity of the fluid is high such as immediately after the engine starts in a low-temperature environment.

In order to prevent the inappropriate operation, for example, it is considered that a phase control hydraulic valve for controlling a working oil supplied to or discharged from an advance chamber and a retard chamber and a lock control hydraulic valve for controlling a lock mechanism are provided. In this configuration, by opening a phase control fluid valve in a state where a fluid is discharged from the lock control hydraulic valve, the state can be reliably shifted to the locked state at the timing when the relative rotation phase reaches the lock phase.

However, in this configuration, the two hydraulic valves are required, and thus, the number of parts increases, an oil passage configuration is complicated, and a size of the configuration increases.

Thus, a need exists for a valve opening/closing timing control device which is not susceptible to the drawback mentioned above.

SUMMARY

A feature of an aspect of this disclosure resides in that a valve opening/closing timing control device includes: a driving side rotator which synchronously rotates with a crankshaft of an internal combustion engine; a driven side rotator which is coaxially disposed with a rotation axis of the driving side rotator and integrally rotates with a valve opening/closing camshaft; an advance chamber and a retard chamber which are formed between the driving side rotator and the driven side rotator; a lock mechanism which includes a lock member capable of engaging with a recessed portion formed on one of the driving side rotator and the driven side rotator and provided in the other of the driving side rotator and the driven side rotator; and a connecting bolt which is coaxially disposed with the rotation axis and connects the driven side rotator to the camshaft, in which the connecting bolt includes an internal space which is coaxially formed with the rotation axis, and an advance port communicating with the advance chamber, a retard port communicating with the retard chamber, and a lock port communicating with the recessed portion are formed as through-holes connecting the internal space and an outer periphery to each other, a valve unit is configured to accommodate a spool to be movable in a direction along the rotation axis in the internal space of the connecting bolt, and in the valve unit, the spool includes an internal flow path through which a fluid is supplied about the rotation axis, and a lock drain flow path through which a fluid is discharged from the lock port and a phase control drain flow path through which a fluid is discharged from the advance chamber or the retard chamber are formed to be flow paths different from each other.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Hereinafter, embodiments disclosed here will be described with reference to the drawings.

Basic Configuration

Figure 1:
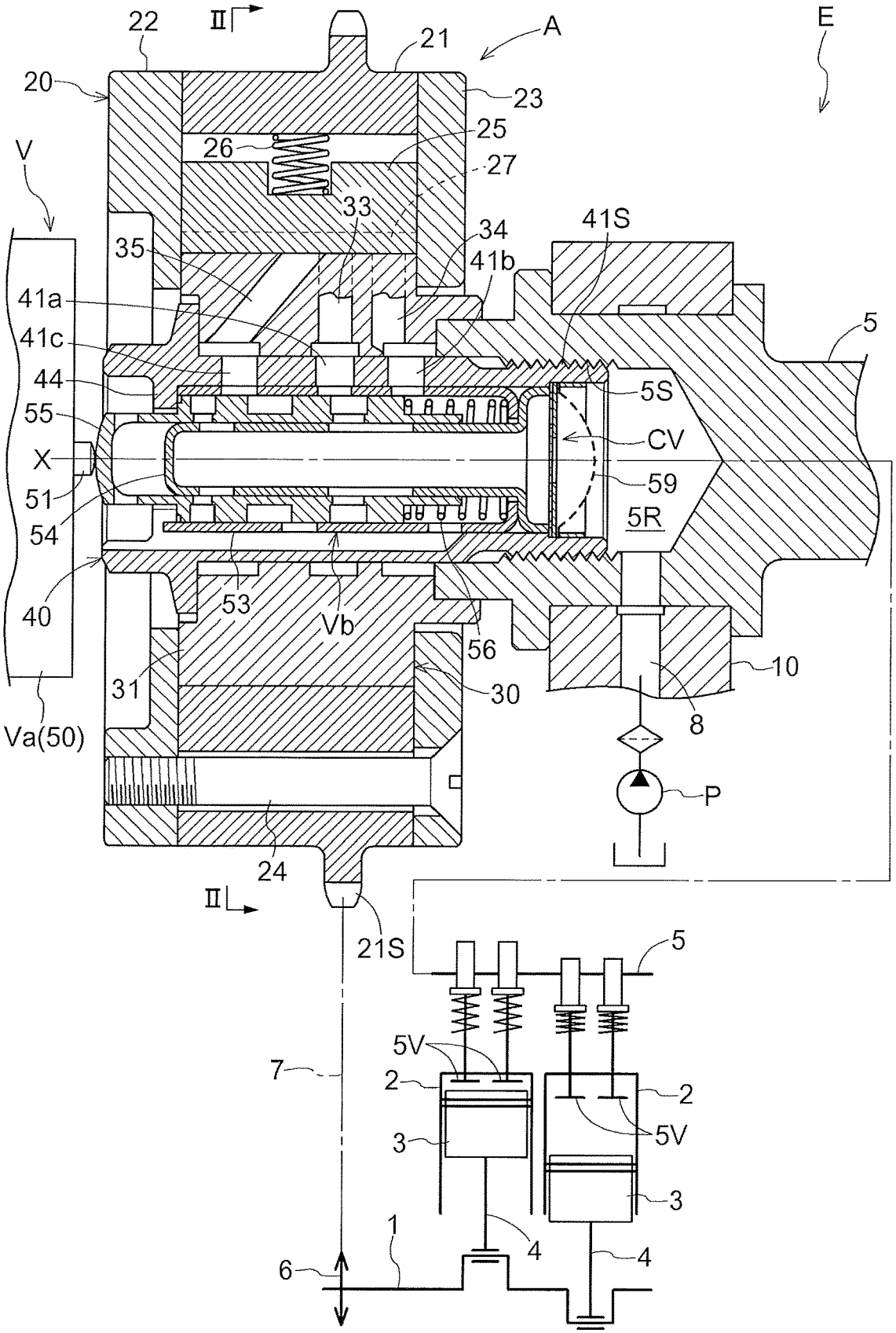
FIG. 1 is a sectional view showing a valve opening/closing timing control device.
Figures 2, 3:
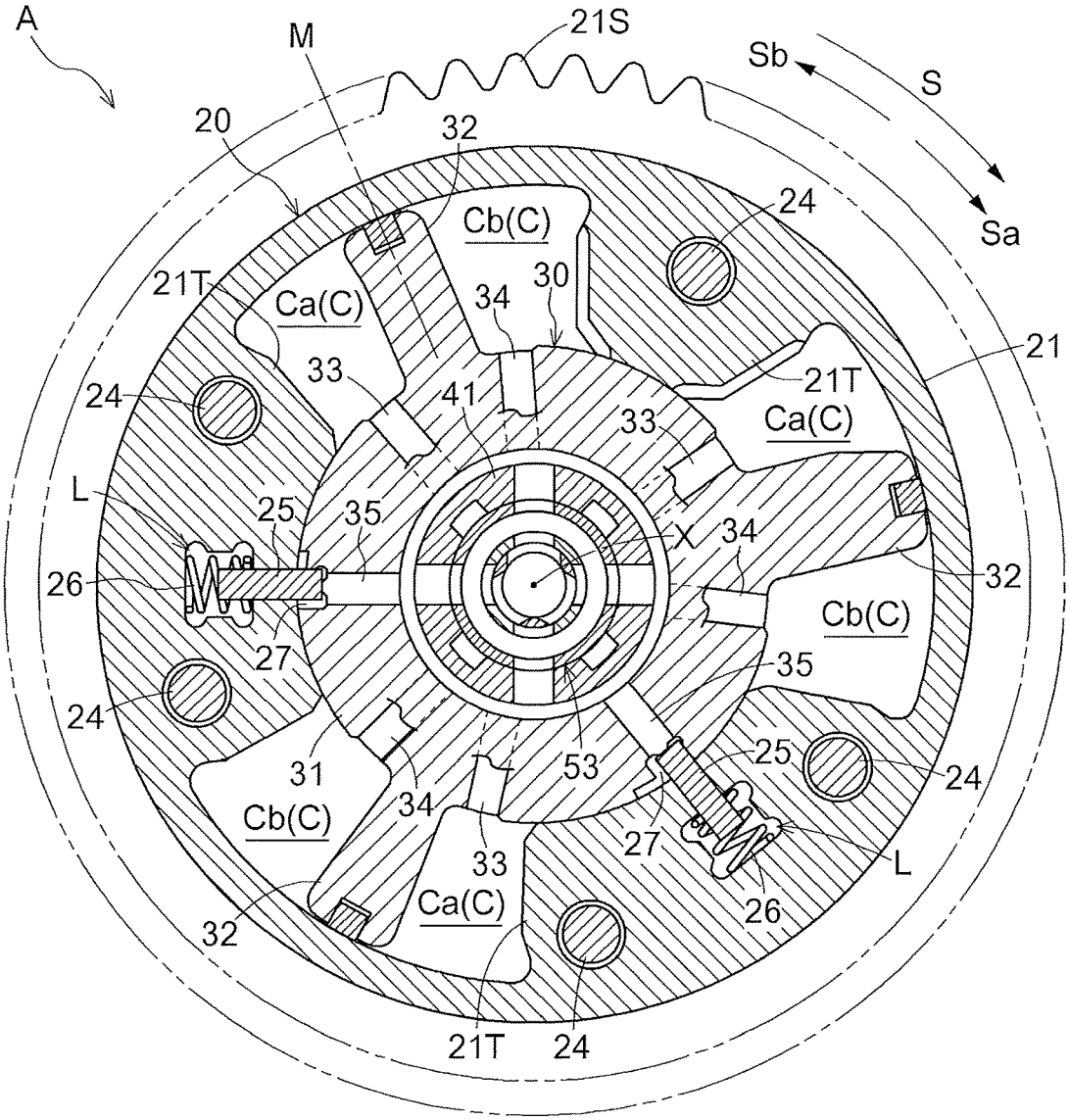
FIG. 2 is a sectional view taken along line II-II of FIG. 1.
FIG. 3 is a table listing a relationship between a position of a spool and supply and discharge of a working oil.

As shown in FIGS. 1 and 2, a valve opening/closing timing control device A is configured to include an external rotor 20 which is a driving side rotator, an internal rotor 30 which is a driven side rotator, and an electromagnetic control valve V for controlling a working oil which is a working fluid.

This valve opening/closing timing control device A is coaxially provided with a rotation axis X of an intake camshaft 5 to set an opening and closing timing of the intake camshaft 5 of an engine E (an example of an internal combustion engine) of a vehicle such as a passenger car.

The internal rotor 30 (an example of the driven side rotator) is coaxially disposed with the rotation axis X of the intake camshaft 5 and is connected to the intake camshaft 5 by a connecting bolt 40 to be integrally rotated with the intake camshaft 5. The external rotor 20 encloses the internal rotor 30, and the external rotor 20 (an example of the driving side rotator) is coaxially disposed with the rotation axis X and synchronously rotates with a crankshaft 1 of the engine E. From this configuration, the external rotor 20 and the internal rotor 30 can rotate relative to each other.

The valve opening/closing timing control device A includes a lock mechanism L which holds a relative rotation phase between the external rotor 20 and the internal rotor 30 at an intermediate lock phase M shown in FIG. 2. This intermediate lock phase M is an opening and closing timing suitable for starting the engine E, and a control shifted to the intermediate lock phase M is performed when a control for stopping the engine E is performed.

The electromagnetic control valve V includes an electromagnetic unit Va and a valve unit Vb which are supported by the engine E. The valve unit Vb includes the connecting bolt 40 and a spool 55 which is accommodated in an internal space 40R of the connecting bolt 40.

The electromagnetic unit Va includes a solenoid portion 50 and a plunger 51 which is coaxially disposed with the rotation axis X and is operated to move forward and backward by controlling driving of the solenoid portion 50. In the valve unit Vb, the spool 55 which controls supply and discharge of the working oil (an example of a working fluid) is coaxially disposed with the rotation axis X and positional relationships are set such that a protrusion end of the plunger 51 abuts on an outer end of the spool 55.

The electromagnetic control valve V sets a protrusion amount of the plunger 51 by controlling power supplied to the solenoid portion 50 to operate the spool 55. According to this operation of the spool 55, the flow of the working oil is controlled to set an opening and closing timing of an intake valve 5V, and thus, switching between a locked state of the lock mechanism L and an unlocked state thereof is performed. The configuration of the electromagnetic control valve V and the control aspect of the working oil will be described below.

Engine and Valve Opening/Closing Timing Control Device

As shown in FIG. 1, the engine E is configured of a four-cycle type engine in which pistons 3 are accommodated in cylinder bores of cylinder blocks 2 positioned at the upper position of the engine E and the pistons 3 and the crankshaft 1 are connected to each other by connecting rods 4. In the upper portion of the engine E, the intake camshaft 5 which opens and closes the intake valves 5V and an exhaust camshaft (not shown) are provided.

A supply flow path 8 through which the working oil form a hydraulic pump P driven by the engine E is supplied is formed in an engine configuration member 10 which rotatably supports the intake camshaft 5. The hydraulic pump P supplies a lubricant stored in an oil pan of the engine E to the valve unit Vb through the supply flow path 8 as the working oil (an example of a working fluid).

A timing chain 7 is wound around an output sprocket 6 formed on the crankshaft 1 of the engine E and a timing sprocket 21S of the external rotor 20. Accordingly, the external rotor 20 synchronously rotates with the crankshaft 1. A sprocket is also provided on a front end of an exhaust camshaft on an exhaust side and the timing chain 7 is wound around this sprocket.

As shown in FIG. 2, the external rotor 20 rotates in a driving rotation direction S by a driving force from the crankshaft 1. A direction in which the internal rotor 30 rotates relative to the external rotor 20 in the same direction as the driving rotation direction S is referred to an advance direction Sa, and a direction opposite to the advance direction Sa is referred to as a retard direction Sb. In the valve opening/closing timing control device A, a relationship between the crankshaft 1 and the intake camshaft 5 is set such that an intake compression ratio increases according to an increase of a displacement amount when the relative rotation phase is displaced in the advance direction Sa and the intake compression ratio decreases according to the increase of the displacement amount when the relative rotation phase is displaced in the retard direction Sb.

In this embodiment, the case where the valve opening/closing timing control device A is provided in the intake camshaft 5 is shown. However, the valve opening/closing timing control device A may be provided in the exhaust camshaft or may be provided in both the intake camshaft 5 and the exhaust camshaft.

External Rotor and Internal Rotor

As shown in FIG. 1, the external rotor 20 includes an external rotor body 21, a front plate 22, and a rear plate 23, and the external rotor body 21, the front plate 22, and the rear plate 23 are integrated by fastening a plurality of fastening bolts 24. A timing sprocket 21S is formed on an outer periphery of the external rotor body 21.

As shown in FIG. 2, a plurality of protrusion portions 21T protruding radially inward are integrally formed with the external rotor body 21. The internal rotor 30 includes a columnar internal rotor body 31 which is in close contact with the protrusion portions 21T of the external rotor body 21 and a plurality of vane portions 32 which protrudes radially outward from the outer periphery of the internal rotor body 31 to be in contact with the inner peripheral surface of the external rotor body 21.

In this way, the external rotor 20 encloses the internal rotor 30, and a plurality of fluid pressure chambers C are formed on the outer peripheral side of the internal rotor body 31 at intermediate positions of the adjacent protrusion portions 21T in the rotation direction. Each of the fluid pressure chambers C is partitioned by the vane portion 32 and thus, the fluid pressure chamber C is divided into an advance chamber Ca and a retard chamber Cb. An advance flow path 33 communicating with the advance chamber Ca and a retard flow path 34 communicating with the retard chamber Cb are formed in the internal rotor body 31.

As shown in FIGS. 1 and 2, the lock mechanism L includes a lock member 25 which is supported to move forward and backward in the radial direction with respect to each of two protrusion portions 21T of the external rotor 20, a lock spring 26 which protrudes to urge the lock member 25, and a lock recessed portion 27 which is formed on the outer periphery of the internal rotor body 31. A lock control flow path 35 which communicates with the lock recessed portion 27 is formed in the internal rotor body 31.

Two lock members 25 simultaneously engage with the corresponding lock recessed portions 27 by urging forces of the lock spring 26, and thus, the lock mechanism L functions to regulate the relative rotation phase to the intermediate lock phase M. In this locked state, by supplying the working oil to the lock control flow paths 35, the lock members 25 are disengaged from the lock recessed portions 27 against the urging forces of the lock springs 26, and thus, the locked state can be released. Conversely, by discharging the working oil from the lock control flow paths 35, the lock members 25 engage with the lock recessed portions 27 by the urging forces of the lock springs 26, and thus, the state can be shifted to the locked state.

The lock mechanism L may be configured such that a single lock member 25 engages with the corresponding single lock recessed portion 27. The lock mechanism L may be configured such that the lock member 25 is guided to move in the direction along the rotation axis X.

Connecting Bolt

Figure 4:
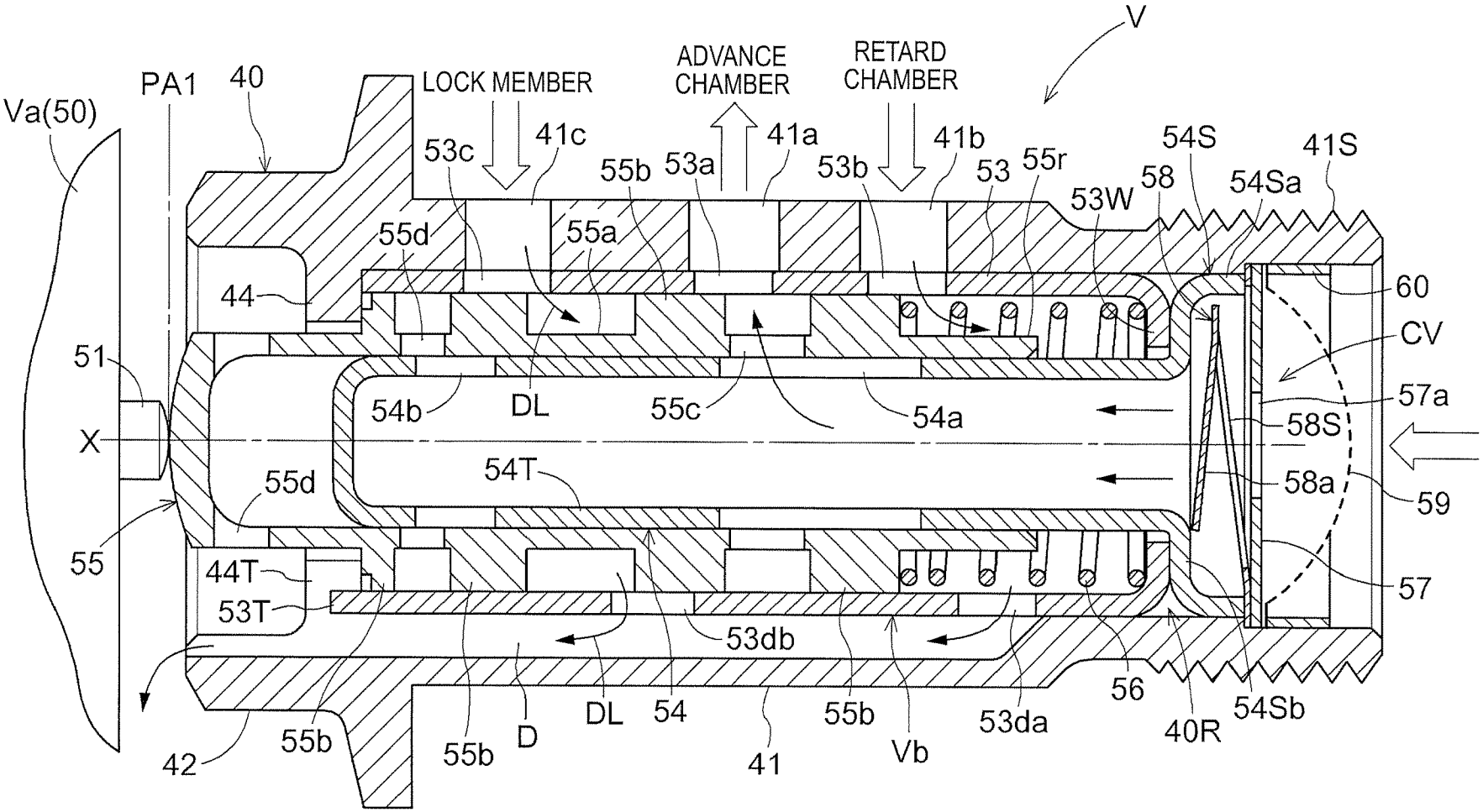
FIG. 4 is a sectional view of a valve unit in which the spool is positioned at a first advance position.
Figure 9:
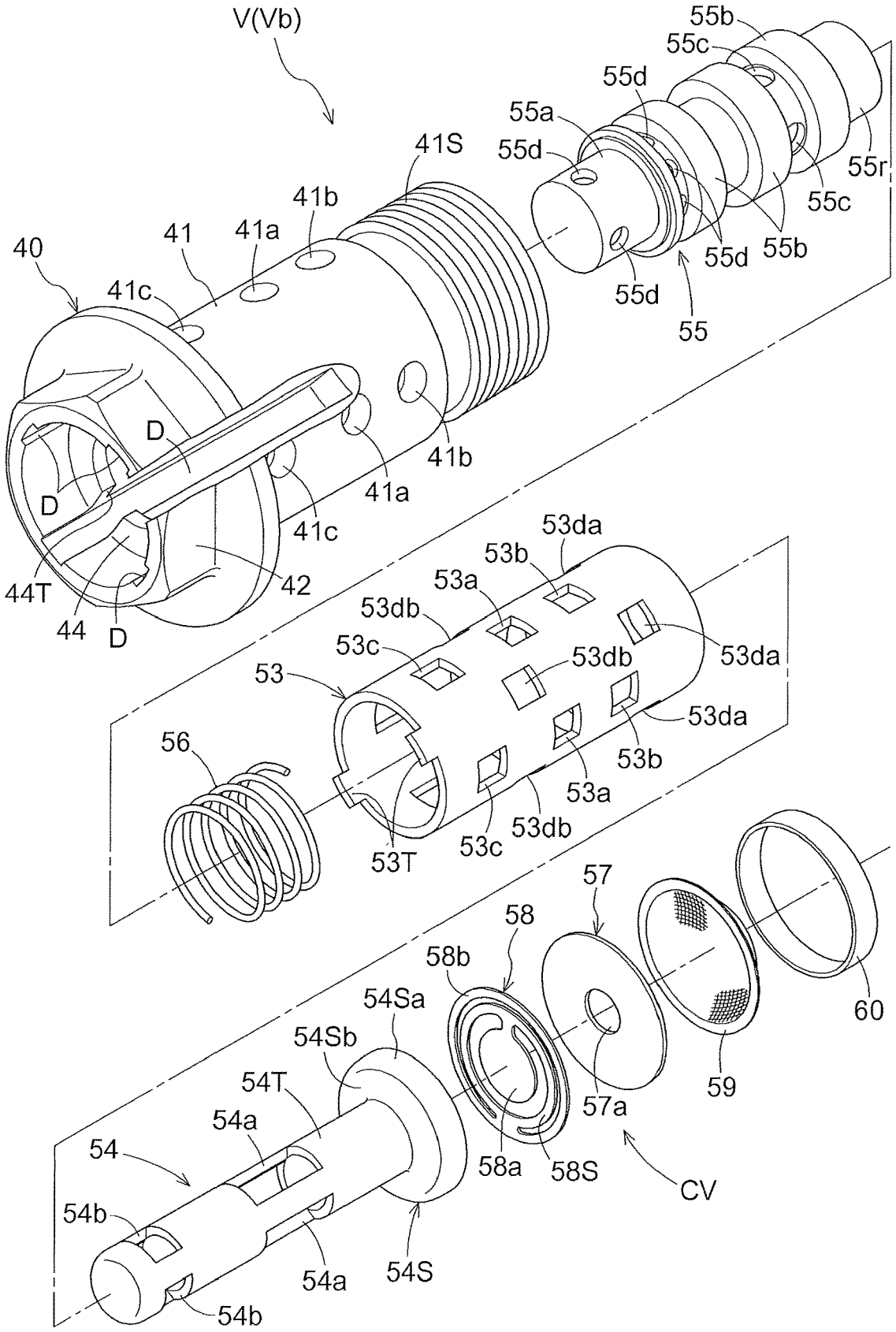
FIG. 9 is an exploded perspective view of the valve unit.

As shown in FIGS. 1, 4, and 9, in the connecting bolt 40, a bolt body 41 which is generally formed in a tubular shape and a bolt head portion 42 on an outer end portion (left side in FIG. 4) are integrally formed to each other. The internal space 40R penetrating in the direction along the rotation axis X is formed inside the connecting bolt 40, and a male screw portion 41S is formed on the outer periphery of the inner end portion (right side in FIG. 4) of the bolt body 41.

As shown in FIG. 1, a shaft inner space 5R is formed about the rotation axis X in the intake camshaft 5, and a female screw portion 5S is formed on the inner periphery of the shaft inner space 5R. The shaft inner space 5R communicates with the supply flow path 8, and thus, the working oil is supplied to the shaft inner space 5R from the hydraulic pump P.

From this configuration, the bolt body 41 is inserted into the internal rotor 30, the male screw portion 41S of the bolt body 41 is screwed to the female screw portion 5S of the intake camshaft 5, and the internal rotor 30 is fastened to the intake camshaft 5 by rotating the bolt head portion 42. The internal rotor 30 is fastened and fixed to the intake camshaft 5 by this fastening, and the shaft inner space 5R communicates with the internal space 40R (strictly, the space inside the fluid supply pipe 54) of the connecting bolt 40.

A regulating wall 44 which is a wall portion protruding in a direction approaching the rotation axis X is formed on the outer end side of the inner peripheral surface of the internal space 40R of the connecting bolt 40 in the direction along the rotation axis X. A plurality of four drain flow paths D are each formed in a groove shape along the rotation axis X in a region from an intermediate position on the inner periphery of the connecting bolt 40 to the tip. Accordingly, engagement recessed portions 44T are formed at portions in which the regulating wall 44 overlaps the four drain flow paths D.

In this configuration, as described below, in a case where the spool 55 is set to a first advance position PA1, the working oil from the retard chambers Cb and the working oil from the lock recessed portions 27 flow to the drain flow paths D. Accordingly, each of the drain flow paths D is shared with a lock drain flow path DL in only a case where the spool 55 is set to the first advance position PA1.

In the bolt body 41, an advance port 41*a* communicating with each of the advance flow paths 33, a retard port 41*b* communicating with each of the retard flow paths 34, and a lock port 41*c* communicating with each of the lock control flow paths 35 are formed as through-holes which connect the internal space 40R and the outer peripheral surface of the bolt body 41 to each other.

An end portion (left end portion in FIG. 4) on an outer end side of a sleeve 53 described later abuts on the regulating wall 44, and thus, the position of the sleeve 53 is regulated. In addition, land portions 55*b* described later of the spool 55 abut on the regulating wall 44, and thus, the position on the protrusion side of each of the land portions 55*b* is regulated.

Valve Unit

As shown in FIGS. 1, 4, and 9, the valve unit Vb includes the sleeve 53 which is fitted in a state of being in close contact with the connecting bolt 40 and the inner peripheral surface of the bolt body 41, a fluid supply pipe 54 which is accommodated in the internal space 40R coaxially with the rotation axis X, and the spool 55 which is disposed to be slidingly movable in the direction along the rotation axis X in a state of being guided by the inner peripheral surface of the sleeve 53 and the outer peripheral surface of a pipeline portion 54T of the fluid supply pipe 54.

The valve unit Vb includes a spool spring 56 which is an urging member urging the spool 55 in the protrusion direction, a check valve CV, an oil filter 59, and a fixing ring 60.

As shown in FIG. 9, the check valve CV includes an opening plate 57 and a valve plate 58 which are formed of metal plates having the same outer diameter as each other. A circular opening portion 57*a* about the rotation axis X is formed at the center position of the opening plate 57. In the valve plate 58, a circular valve body 58*a* having a larger diameter than that of the above-described opening portion 57*a* is disposed at the center position of the valve plate 58, an annular portion 58*b* is disposed on the outer periphery of the valve plate 58, and a spring portion 58S which connects the valve body 58*a* and the annular portion 58*b* to each other is provided.

In the check valve CV, in a case where a pressure on the downstream side of the check valve CV increases or in a case where a discharge pressure of the hydraulic pump P decreases, the valve body 58*a* comes into close contact with the opening plat 57 by the urging force of the spring portion 58S to close the opening portion 57*a*.

The oil filter 59 is configured to include a filtering portion having a mesh member of which a center portion having the same outer diameter as those of the opening plate 57 and the valve plate 58 expands toward the upstream side in the supply direction of the working oil. The fixing ring 60 is press-fitted and fixed to the inner periphery of the connecting bolt 40, and the positions of the oil filter 59, the opening plate 57, and the valve plate 58 are determined by the fixing ring 60.

Valve Unit: Sleeve

As shown in FIGS. 1, 4, and 9, the sleeve 53 is formed in a tubular shape about the rotation axis X, and in the sleeve 53, a plurality of (two) engagement protrusions 53T protruding in the direction along the rotation axis X are formed on the outer end side (left side in FIGS. 4 and 9) of the sleeve 53, the inner end side (right side in FIG. 4) of the sleeve 53 is bent to be orthogonal to the rotation axis X, and thus, an end wall 53W is formed by drawing or the like.

The regulating wall 44 is formed in an annular region. Meanwhile, the four engagement recessed portions 44T are formed by notching the portions corresponding to the drain flow paths D.

In the sleeve 53, a plurality of advance communication hole 53*a* causing the advance ports 41*a* to communicate with the internal space 40R, a plurality of retard communication hole 53*b* causing the retard ports 41*b* to communicate with the internal space 40R, and a plurality of lock communication hole 53*c* causing the lock ports 41*c* to communicate with the internal space 40R are formed. In the sleeve 53, first drain holes 53*da* are formed on the inner end side, and second drain holes 53*db* are formed on the outer end side from the first drain holes 53*da*.

The advance communication holes 53*a*, the retard communication holes 53*b*, and the lock communication holes 53*c* are each formed to be arranged in the direction along the rotation axis X at four locations in a circumferential direction about the rotation axis X. The first drain holes 53*da* and the second drain holes 53*db* are each formed in phases different from those of the advance communication holes 53*a*, the retard communication holes 53*b*, and the lock communication holes 53*c* at four locations in the circumferential direction about the rotation axis X.

The above-described engagement protrusions 53T are disposed on the extension line in the direction along the rotation axis X at the same phase as those of the drain holes positioned at two locations facing each other in a state where the rotation axis X is interposed therebetween among the first drain holes 53*da* and the second drain holes 53*db* formed at the four locations.

From this configuration, the engagement protrusions 53T engage with the engagement recessed portions 44T of the regulating wall 44, and the sleeve 53 is fitted in a state where the front end edge of the sleeve 53 abuts on the regulating wall 44.

The advance communication holes 53*a* communicate with the advance ports 41*a*, the retard communication holes 53*b* communicate with the retard ports 41*b*, and the lock communication holes 53*c* communicate with the lock ports 41*c*. The first drain holes 53*da* and the second drain holes 53*db* communicate with the drain flow path D.

Valve Unit: Fluid Supply Pipe

As shown in FIGS. 4 and 9, in the fluid supply pipe 54, a base end portion 54S fitted into the internal space 40R and the pipeline portion 54T having a smaller diameter than that of the base end portion 54S are integrally formed, a plurality of (three) first supply ports 54*a* are formed at a position close to the base end portion 54S on the outer periphery on the tip portion of the pipeline portion 54T, and a plurality of (three) second supply ports 54*b* are formed on the outer end side than the first supply ports 54*a*.

The base end portion 54S includes a fitting tubular portion 54Sa about the rotation axis X and an intermediate wall 54Sb which is formed in a region from the fitting tubular portion 54Sa to the pipeline portion 54T and is orthogonal to the rotation axis X.

The three first supply ports 54*a* are wide in the circumferential direction and elongated in the direction along the rotation axis X, and four intermediate hole portions 55*c* which are formed in the spool 55 at the positions corresponding to the first supply ports 54*a* are each formed in a circular shape. From this configuration, it is possible to reliably supply the working oil from the pipeline portion 54T to the intermediate hole portions 55*c*.

Similarly to the first supply ports 54*a*, the second supply ports 54*b* extend in the direction along the rotation axis X, and four end hole portions 55*d* formed in the spool 55 at the positions corresponding to the second supply ports 54*b* are each formed in a circular shape. From this configuration, it is possible to reliably supply the working oil from the pipeline portion 54T to the end hole portions 55*d*.

Valve Unit: Spool and Spool Spring

As shown in FIGS. 4 and 9, in the spool 55, a spool body 55*a* which is formed in a tubular shape and has an abutment surface formed on the outer end side, and four land portions 55*b* which are formed on the outer periphery to protrude are formed. The internal flow path is formed inside the spool 55, the plurality of (four) intermediate hole portions 55*c* communicating with the internal flow path are formed at an intermediate position between a pair of land portions 55*b* on the inner end side in the direction along the rotation axis X, and the end hole portions 55*d* communicating with the internal flow path are formed at an intermediate position between a pair of land portions 55*b* on the outer end side in the direction along the rotation axis X.

In the spool 55, an abutment end portion 55*r*, which abuts on the end wall 53W and determines the operation limit when the spool 55 is operated in a pushing-in direction, is formed on a side opposite to the abutment surface. The abutment end portion 55*r* is provided on the end portion of the region in which the spool body 55*a* extends and prevents the spool 55 from operating over the operation limit even when the spool 55 is pushed-in by an excessive force. In order to determine the operation limit when the spool 55 is operated in the pushing-in direction, a configuration may be adopted in which the inner surface on the outer end side (the inner end on the left side of the FIG. 4) of the spool 55 and the end portion on the protrusion side (the outer end on the left side of FIG. 4) of the fluid supply pipe 54 abut on each other when the spool 55 is operated in the pushing-in direction.

The spool spring 56 is a compression coil type spring and is disposed between the land portion 55*b* on the inner end side and the end wall 53W of the sleeve 53. In a case where power is not supplied to the solenoid portion 50 of the electromagnetic unit Va by the urging force of the spool spring 56, the land portion 55*b* on the outer end side abuts on the regulating wall 44, and the spool 55 is maintained at the first advance position PA1 shown in FIG. 4.

In the valve unit Vb, a positional relationship is set such that the end wall 53W of the sleeve 53 and the intermediate wall 54Sb of the fluid supply pipe 54 abut on each other, and it is possible to suppress the flow of the working oil by increasing planar accuracy between the end wall 53W and the intermediate wall 54Sb abutting on each other.

That is, in this configuration, the position of the base end portion 54S of the fluid supply pipe 54 is fixed by the fixing ring 60, and thus, the base end portion 54S functions as a retainer. The urging force of the spool spring 56 acts on the end wall 53W of the sleeve 53, and thus, the end wall 53W is in pressure contact with the intermediate wall 54Sb of the base end portion 54S. Accordingly, the end wall 53W is in close contact with the intermediate wall 54Sb using the urging force of the spool spring 56, and thus, it is possible to prevent leakage of the working oil at this portion.

Detail of Valve Unit

From the above-described configurations, in a case where the valve unit Vb is assembled, the spool spring 56 and the spool 55 are inserted into the sleeve 53, and this sleeve 53 is inserted into the internal space 40R of the connecting bolt 40. During this insertion, the engagement protrusions 53T of the sleeve 53 engage with the engagement recessed portions 44T of the regulating wall 44, and thus, a relative rotation posture between the connecting bolt 40 and the sleeve 53 about the rotation axis X is determined.

Next, the fluid supply pipe 54 is disposed such that the pipeline portion 54T of the fluid supply pipe 54 is inserted into the inner periphery of the spool body 55*a* of the spool 55. Accordingly, the base end portion 54S of the fluid supply pipe 54 is positioned to be fitted into the inner peripheral wall of the internal space 40R of the connecting bolt 40.

In this positional relationship, the opening plate 57 and the valve plate 58 configuring the check valve CV are disposed to overlap each other, the oil filter 59 is disposed in the internal space 40R to further overlap the overlapped opening plate 57 and valve plate 58, and the fixing ring 60 is fitted and fixed to the inner periphery of the internal space 40R.

In this way, according to the fixing of the fixing ring 60, the outer end portion of the sleeve 53 abuts on the regulating wall 44, and the position in the direction along the rotation axis X is determined. Instead of the fixing ring 60, a snap ring may be used.

Operation Aspect

In the valve opening/closing timing control device A, in a state where power is not supplied to the solenoid portion 50 of the electromagnetic unit Va, a pressing force from the plunger 51 does not act on the spool 55, and as shown in FIG. 4, the position of the spool is maintained by the urging force of the spool spring 56 in a state where the land portions 55*b* at the outer side position of the spool 55 abut on the regulating wall 44.

This position of the spool 55 is the first advance position PA1. By increasing the power supplied to the solenoid portion 50 of the electromagnetic unit Va, as shown in FIG. 3, a second advance position PA2, a neutral position PN, a second retard position PB2, and a first retard position PB1 can be operated in this order. That is, the spool 55 can be operated to any one position of the five positions by setting power supplied to the solenoid portion 50 of the electromagnetic unit Va.

In this valve unit Vb, the first advance position PA1 and the first retard position PB1 are locked positions, and in the lock positions, the shifting of the lock mechanism L to the locked state can be performed. In a case where the spool 55 is operated to the first retard position PB1, the power supplied to the solenoid portion 50 is the maximum.

In a case where the spool 55 is operated to any one of the first advance position PA1 and the second advance position PA2, the working oil supplied from the hydraulic pump P is fed to the advance port 41*a* via the intermediate hole portions 55*c* of the spool 55 and the advance communication holes 53*a* and the working oil is supplied from the advance flow paths 33 to the advance chambers Ca. At the same time, the working oil from the retard chambers Cb flows from the retard flow paths 34 to the retard ports 41*b* and is discharged from the first drain holes 53*da* to the drain flow paths D.

Particularly, in the first advance position PA1, as shown in FIG. 4, the working oil of the lock recessed portions 27 flows the lock control flow paths 35 to the lock ports 41*c* and is discharged from the second drain holes 53*db* to the drain flow paths D. That is, the second drain holes 53*db* are positioned on the downstream side of the first drain holes 53*da*, the second drain holes 53*db* are close to the outer end position of the connecting bolt 40, and thus, the working oil is easily discharged from the lock recessed portions 27. According to the supply and discharge of the working oil, the lock mechanism L is shifted to the locked state when the relative rotation phase reaches the intermediate lock phase M while the relative rotation phase is displaced in the advance direction Sa.

Figure 5:
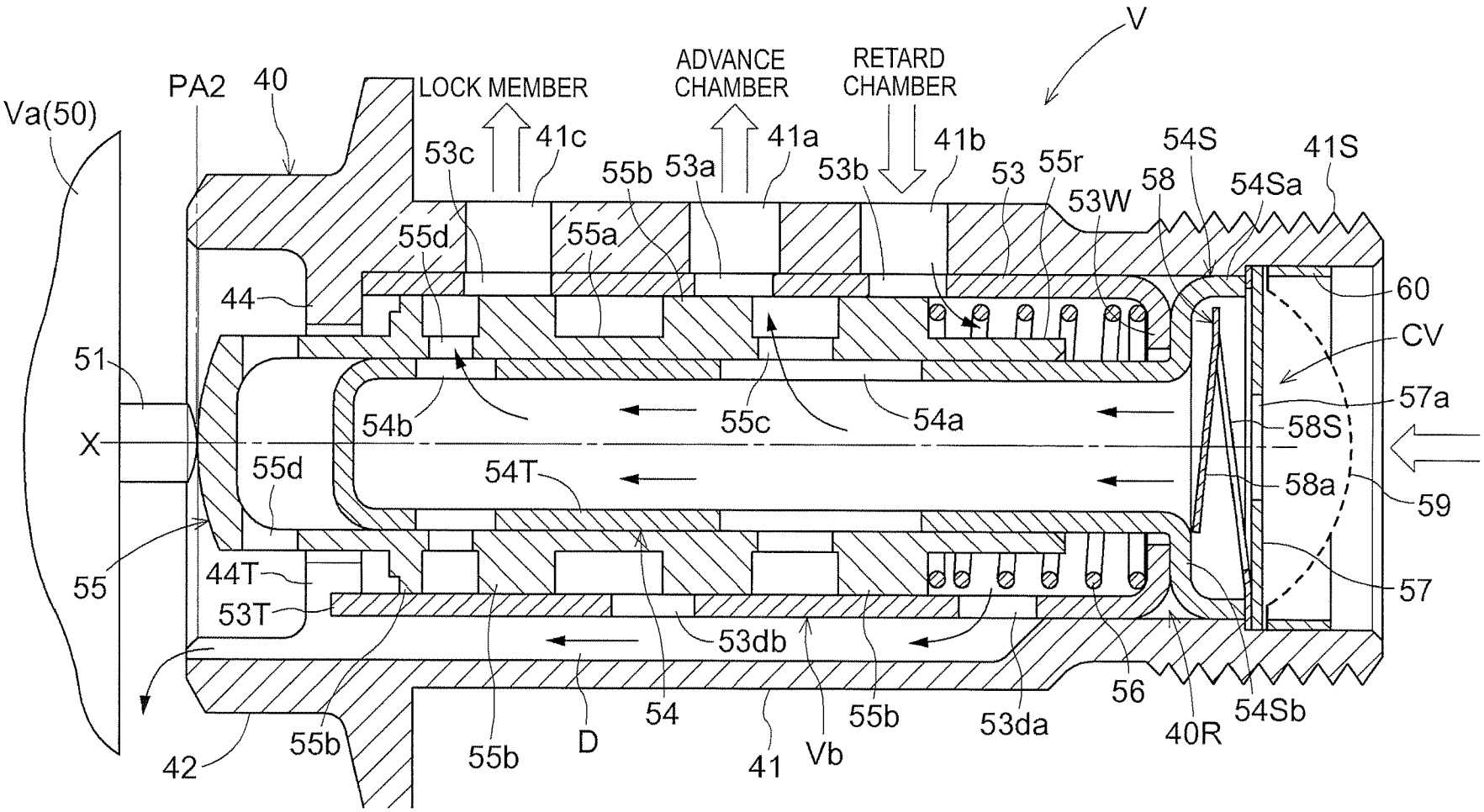
FIG. 5 is a sectional view of the valve unit in which the spool is positioned at a second advance position.

In the second advance position PA2, as shown in FIG. 5, the working oil flows the lock ports 41*c* to the lock recessed portions 27 via the lock control flow paths 35 in conjunction with the supply of the working oil to the advance chambers Ca and the pressure of the working oil acts on the lock members 25. Accordingly, the operation in the advance direction Sa is continuously performed in a state where the lock mechanism L is unlocked.

Figure 6:
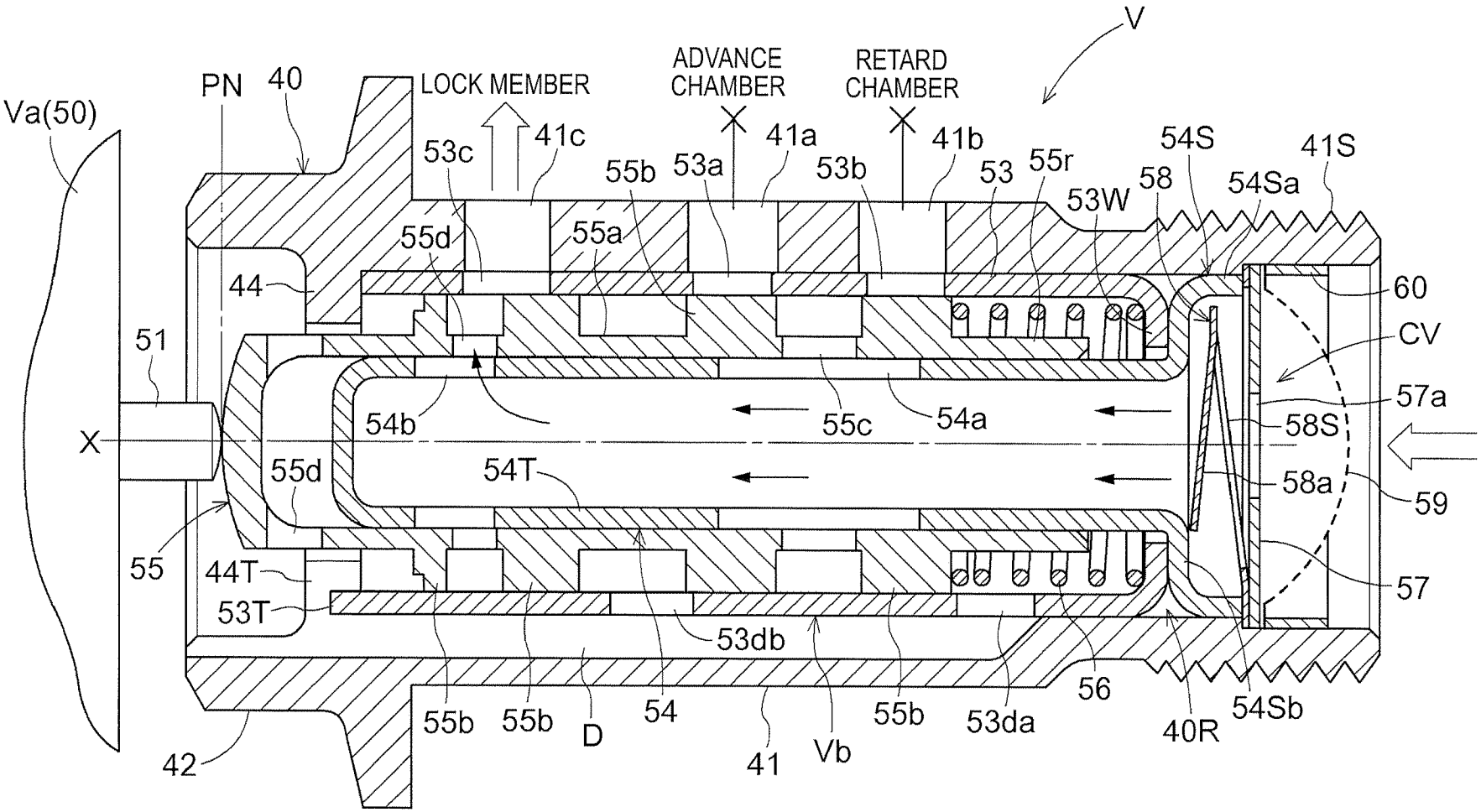
FIG. 6 is a sectional view of the valve unit in which the spool is positioned at a neutral position.

In a case where the spool 55 is operated to the neutral position PN, as shown in FIG. 6, the pair of land portions 55*b* close the advance communication holes 53*a* and the retard communication holes 53*b* of the sleeve 53, and the supply and discharge of the working oil with respect to the advance chambers Ca and the retard chambers Cb are interrupted to maintain the relative rotation phase.

In the neutral position PN, the working oil flows from the lock ports 41*c* to the lock recessed portions 27 via the lock control flow paths 35, the pressure of the working oil acts on the lock members 25, and the unlocked state of the lock mechanism L is continued.

In a case where the spool 55 is operated to any one of the second retard position PB2 and the first retard position PB1, the working oil supplied from the hydraulic pump P is fed to the retard ports 41*b* via the intermediate hole portions 55*c* of the spool 55 and the retard communication holes 53*b* and is supplied from the retard flow paths 34 to the retard chambers Cb. At the same time, the working oil in the advance chambers Ca flows from the advance flow paths 33 to the advance ports 41*a* and is discharged from the second drain holes 53*db* to the drain flow paths D.

Figure 7:
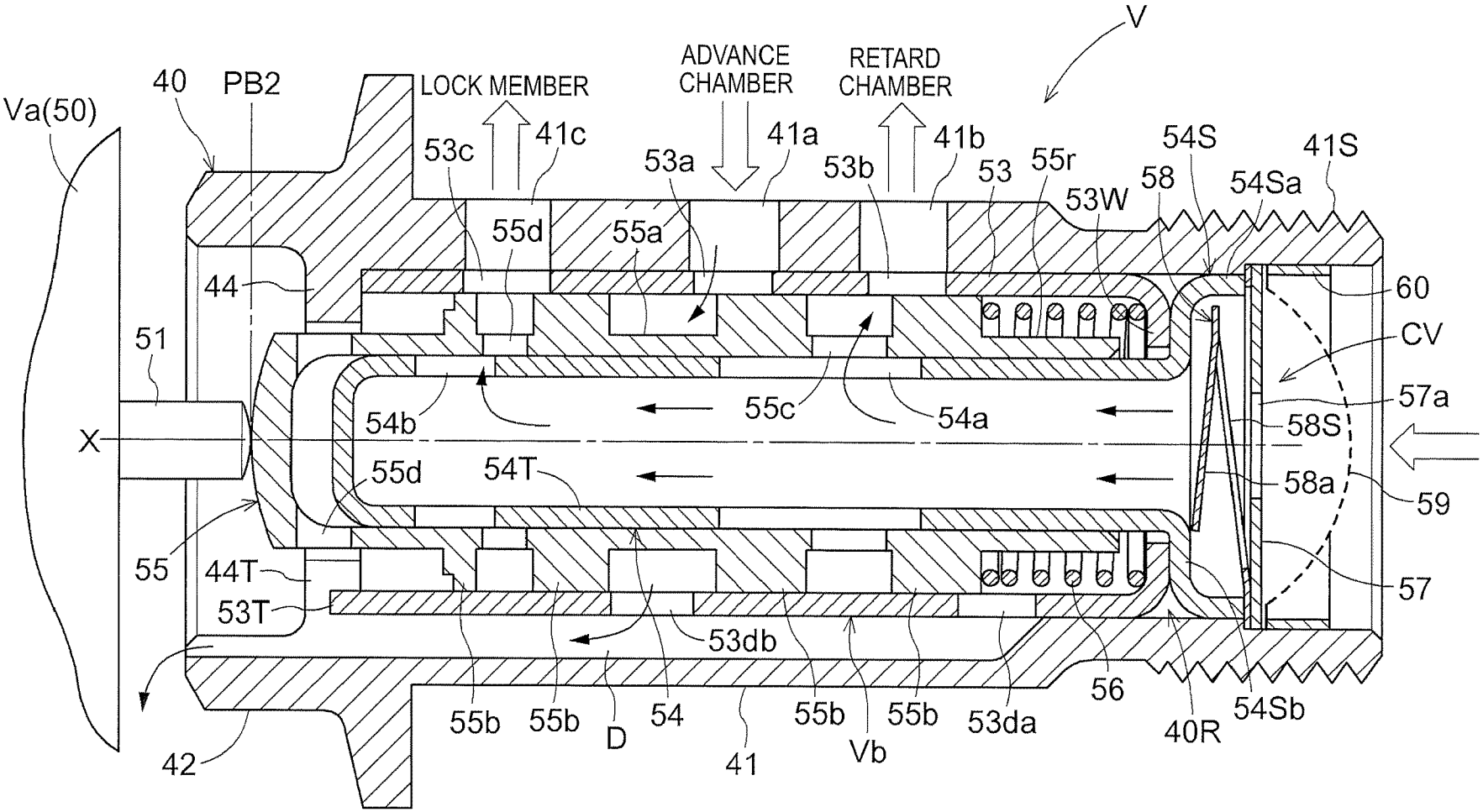
FIG. 7 is a sectional view of the valve unit in which the spool is positioned at a second retard position.

Particularly, in the second retard position PB2, as shown in FIG. 7, the working oil flows from the lock ports 41*c* to the lock recessed portions 27 via the lock control flow paths 35 in conjunction with the supply of the working oil to the retard chambers Cb and the pressure of the working oil acts on the lock members 25. Accordingly, the operation in the retard direction Sb is continuously performed in a state where the lock mechanism L is unlocked.

Figure 8:
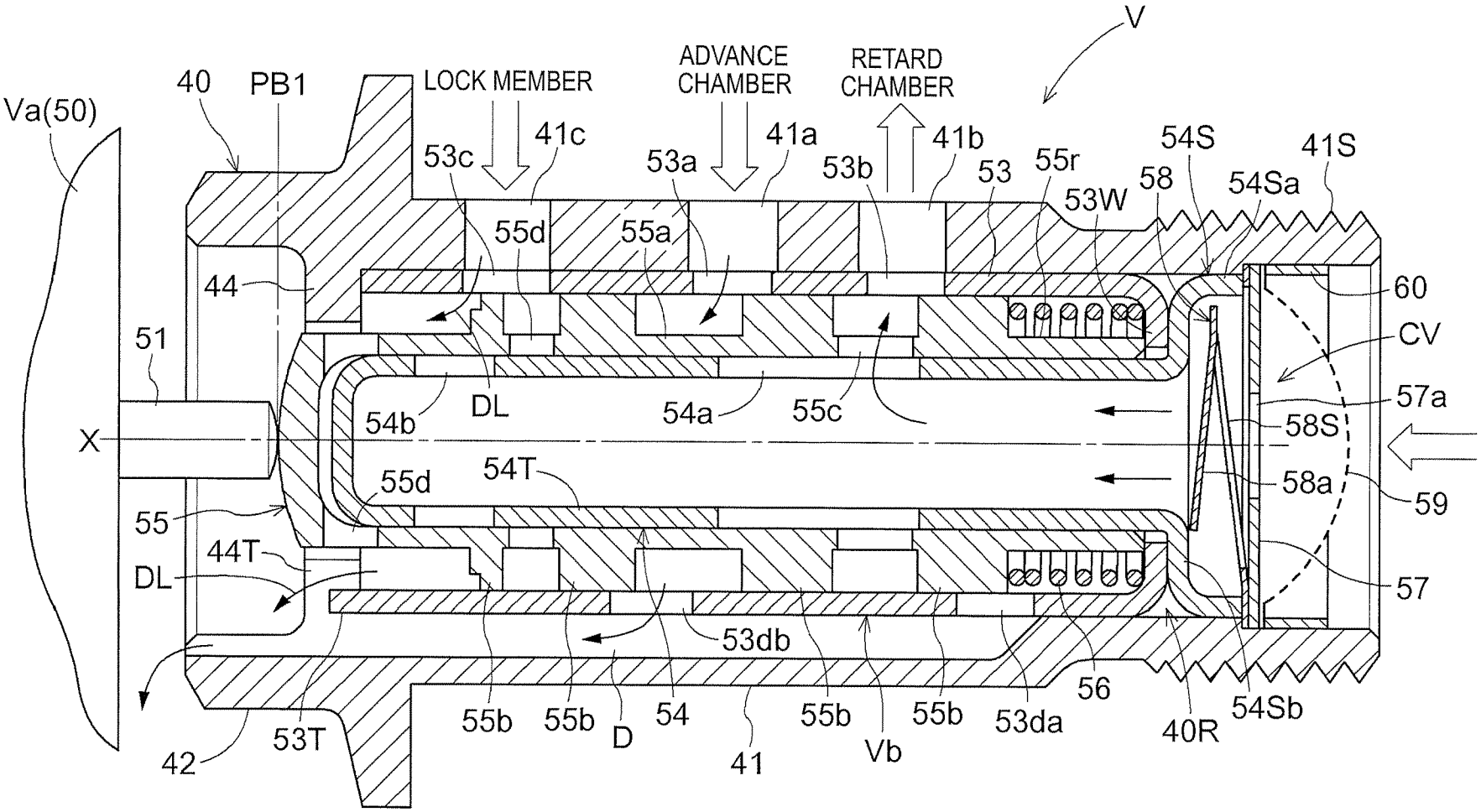
FIG. 8 is a sectional view of the valve unit in which the spool is positioned at a first retard position.

In the first retard position PB1, as shown in FIG. 8, the working oil in the lock recessed portions 27 flows from the lock control flow paths 35 to the lock ports 41*c* and is directly discharged from the outer end position of the spool 55 to the outer end side of the connecting bolt 40. According to the supply and discharge of the working oil, the lock mechanism L is shifted to the locked state when the relative rotation phase reaches the intermediate lock phase M while the relative rotation phase is displaced in the retard direction Sb.

Particularly, the region through which the working oil is directly discharged from the outer end position of the spool 55 to the outer ends side of the connecting bolt 40 is the lock drain flow path DL, and the lock drain flow path DL is formed to be a region different from the drain flow path D through which the working oil is discharged from the advance chambers Ca. Accordingly, the working oil is rapidly discharged, and thus, the lock mechanism L is rapidly shifted to the locked state.

Operational Effects of Embodiment

In this way, the working oil in the internal flow path of the spool 55 is supplied to the advance chambers Ca, the retard chambers Cb, and the lock recessed portions 27, the working oil from each of these chambers and recessed portions can be discharged by the operation of the single spool 55, and thus, it is possible to decrease the size of the valve opening/closing timing control device A.

The working oil can be linearly supplied to the fluid supply pipe 54 along the rotation axis X, and thus, a pressure loss decreases, the working oil is supplied to the advance chambers Ca and the retard chambers Cb without decreasing the pressure, and high responsiveness is maintained. The opening portion 57*a* of the opening plate 57 of the check valve CV is coaxially disposed with the rotation axis X, and thus, the check valve CV does not act as a resistance to the oil passage.

The working oil discharged from the first drain holes 53*da* or the second drain holes 53*db* formed in the sleeve 53 is discharged from the head portion side of the connecting bolt 40 via the drain flow path D which is the boundary between the outer surface of the sleeve 53 and the inner surface of the connecting bolt 40, and thus, the configuration of the drain flow path is simplified. Accordingly, the number of parts does not increase and the machining process is not complicated.

Particularly, the lock drain flow path DL is formed as the flow path different from the drain flow path D, and thus, in a case where the lock mechanism L is unlocked, the working oil is discharged from the lock recessed portions 27 without being obstructed. Accordingly, even in a case where the temperature of the working oil is low and the viscosity thereof is high, the shifting of the lock mechanism L to the locked state is rapidly and reliably performed.

Other Embodiments

The embodiment disclosed here may be configured as follows in addition to the above-described embodiment (same reference numerals are assigned to configurations having the same functions as those of the embodiment).

Figure 10:
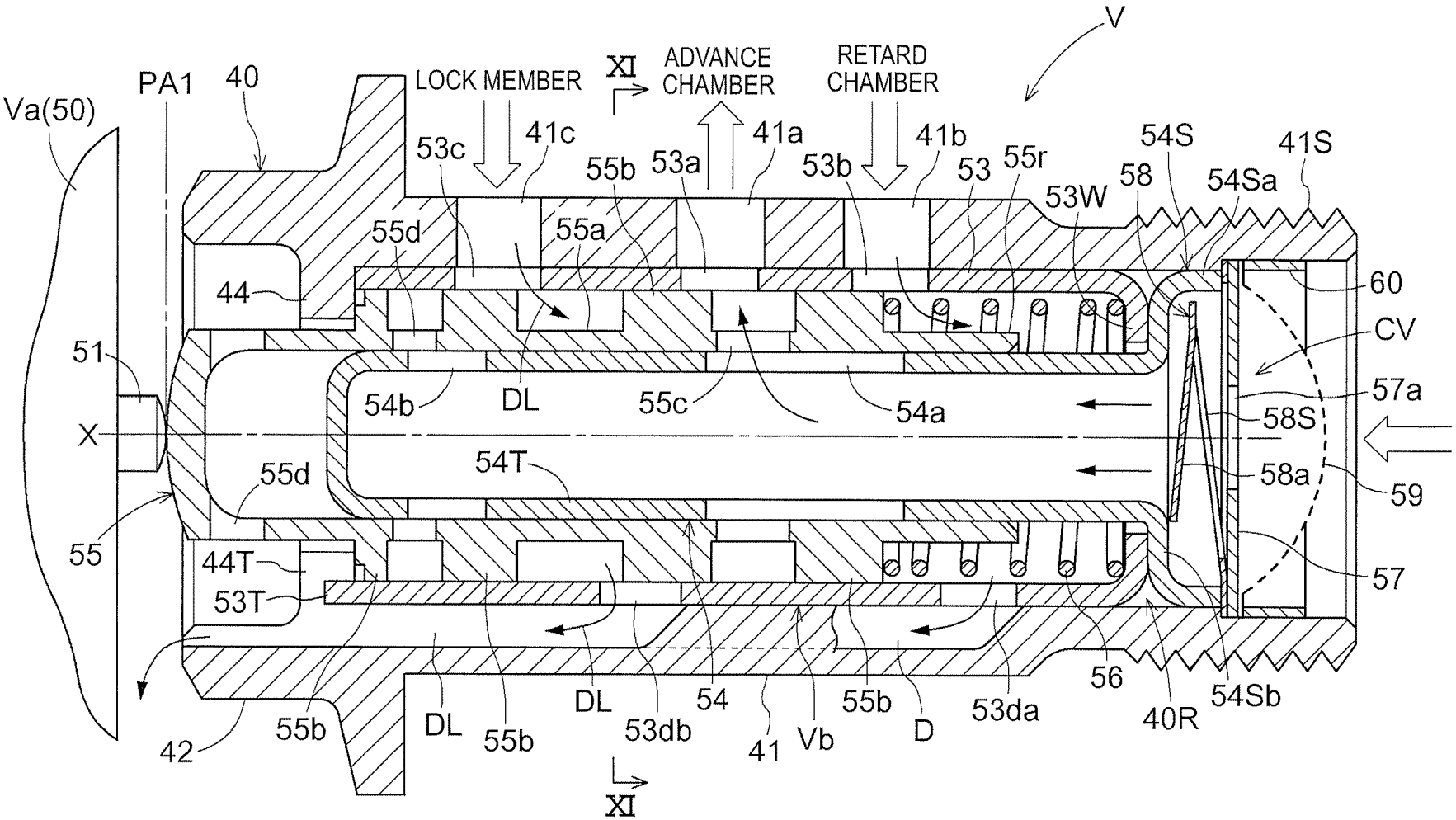
FIG. 10 is a sectional view of a valve unit of another embodiment.
Figure 11:
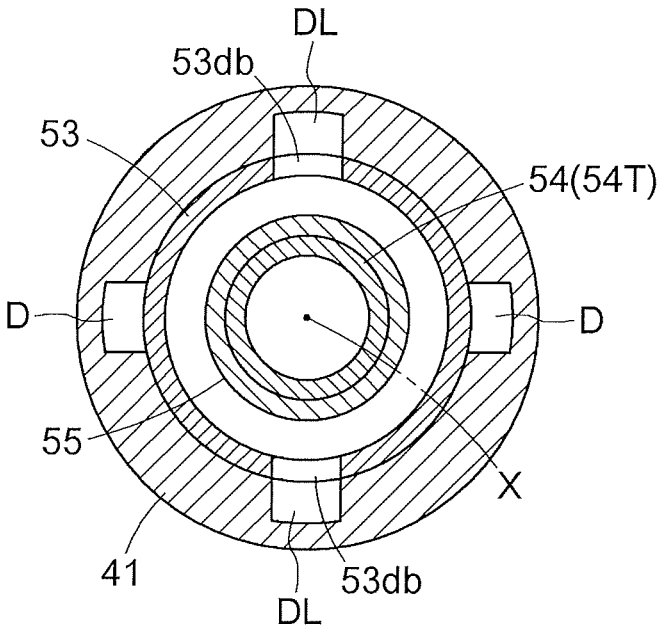
FIG. 11 is a sectional view taken along line XI-XI of FIG. 10.
Figure 12:
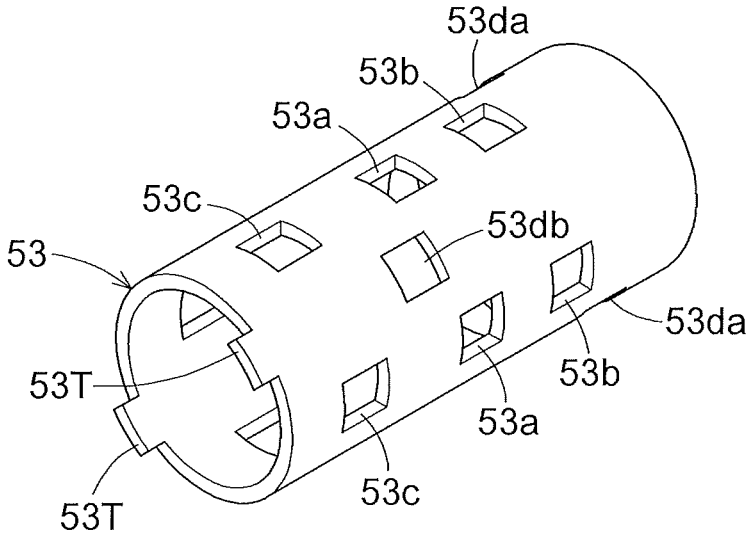
FIG. 12 is a perspective view of a sleeve of another embodiment.

(a) As shown in FIGS. 10 to 12, the second drain holes 53*db* are formed in the sleeve 53 to have phases different from the phases of the advance communication holes 53*a* and the retard communication holes 53*b* about the rotation axis X and the phases of the first drain holes 53*da*. The lock drain flow paths DL are each formed in a groove shape on the inner periphery of the connecting bolt 40 to communicate with the second drain holes 53*db*.

In another embodiment (a), in the sleeve 53, a pair of first drain holes 53*da* and a pair of second drain holes 53*db* are formed, and in the inner peripheral surface of the connecting bolt 40, a pair of drain flow paths D communicating with the pair of first drain holes 53*da* is formed and a pair of lock drain flow paths DL communicating with the pair of first drain holes 53*da* is formed in a groove shape.

In this way, the drain flow paths D and the lock drain flow paths DL are formed at positions different from each other, and in a case where the working oil flows to the drain flow paths D and the lock drain flow paths DL, the working oil can be individually discharged without being mixed with each other.

Accordingly, as shown in FIG. 10, in a case where the spool 55 is positioned at the first advance position PA1, the working oil in the lock recessed portions 27 flows from the lock control flow paths 35 to the lock ports 41*c*, flows from the second drain holes 53*db* to the lock drain flow paths DL, and are discharged to the outer end side of the connecting bolt 40. Moreover, in the configuration of another embodiment (a), in a case where the spool 55 is operated to be positioned at the first retard position PB1, the working oil can be discharged from the outer end position of the spool 55 to the outer end side of the connecting bolt 40 via the lock drain flow paths DL (refer to FIG. 8).

Accordingly, for example, like the case where the spool 55 is operated from other operation positions to the first advance position PA1, in a case where the working oil is discharged from the retard chambers Cb, it is possible to eliminate inconvenience of the flow of the working oil restricting the flow of the working oil discharged from the lock ports 41*c*, and thus, the shifting of the lock mechanism L to the locked state is rapidly and reliably performed.

As a modification example of another embodiment (a), the groove of each of the drain flow paths D and the lock drain flow paths DL may be deeply formed or the number of the drain flow paths D and the lock drain flow paths DL may increase to increase the flow path cross-sectional areas.

As a modification example of another embodiment (a), the groove forming each of the drain flow paths D and the lock drain flow paths DL may be formed on the outer periphery of the sleeve 53.

Figure 13:
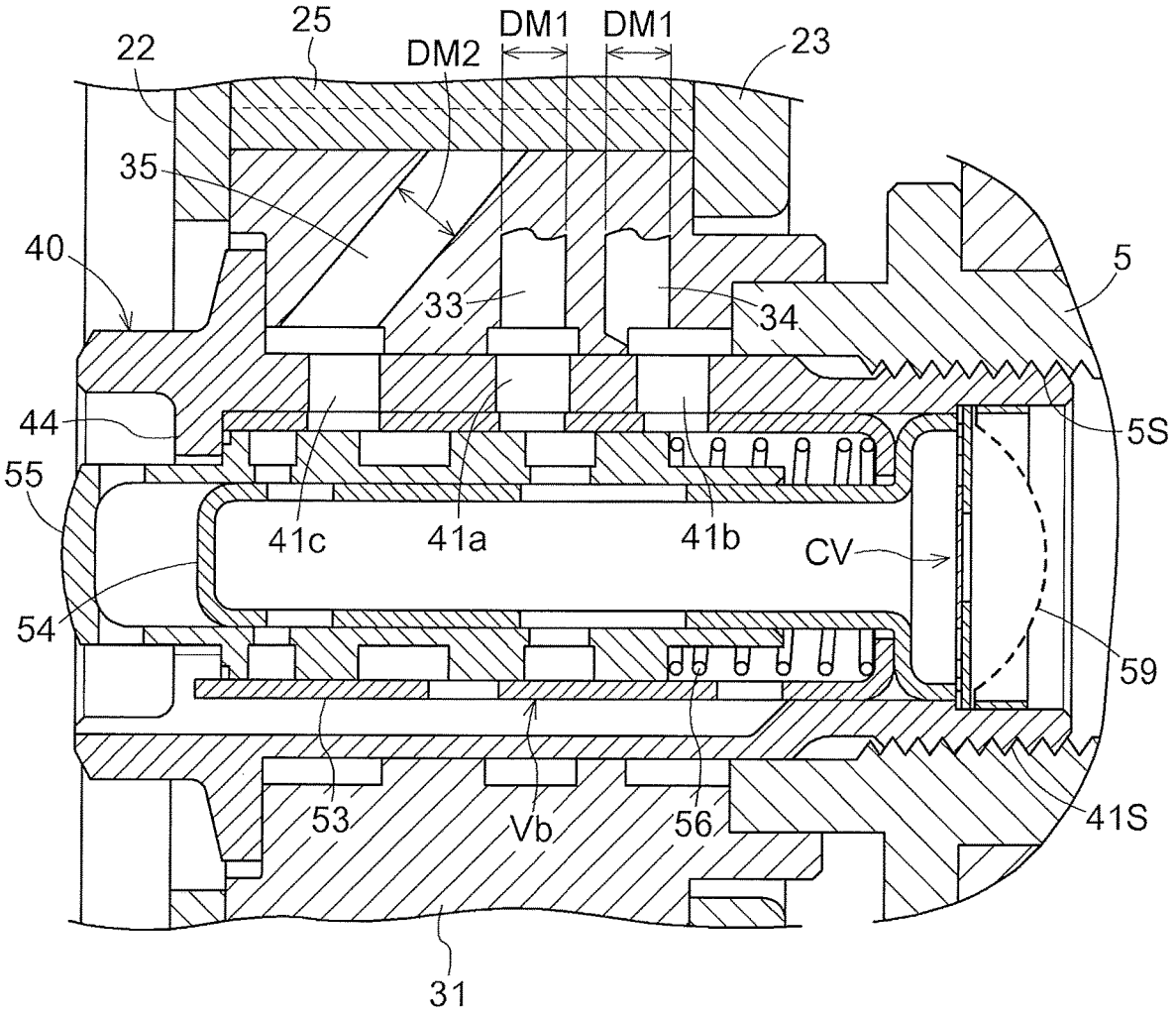
FIG. 13 is a sectional view showing a flow path in still another embodiment.

(b) As shown in FIG. 13, the flow path cross-sectional area of each of the lock control flow paths 35 is set to be larger than the flow path cross-sectional area of each of the advance flow paths 33 and the flow path cross-sectional area of each of the retard flow paths 34. In still another embodiment (b), when the diameter of the advance flow path 33 and the diameter of the retard flow path 34 are each defined as DM1 and the diameter of the lock control flow path 35 is defined as DM2, a relationship of DM1<DM2 is set.

That is, in a flow path formed in a hole shape, a resistance of the flow path decreases as the flow path cross-sectional area increases. Accordingly, discharge of the working oil is rapidly performed by increasing the flow path cross-sectional area of the lock control flow path 35, and the shifting of the lock mechanism L to the locked state is rapidly and reliably performed. From the viewpoint of the resistance of the flow path, it is effective to increase the diameters of the advance flow paths 33, the retard flow paths 34, and the lock control flow paths 35. However, according to the increase in the diameters, the size of the valve opening/closing timing control device A increases. Accordingly, the size of the valve opening/closing timing control device A is decreased by causing the diameters of the flow paths to be different to each other.

(c) In the above-described embodiments, the spool 55 can be operated to the five positions. However, for example, the operation region may be set such that the first advance position PA1 does not exist, and thus, the spool 55 may be operated to four positions.

In a configuration in which the spool 55 is operated to the four operation positions without having the first advance position PA1, in a case where the state is shifted to the locked state in the intermediate lock phase M, the relative rotation phase may be set to the advance side from the intermediate lock phase M, and, by operating the spool 55 to the first retard position PB1, the state is shifted to the locked state while the relative rotation phase is displaced in the retard direction Sb.

(d) Compared to the above-described embodiment, the valve unit Vb may be configured such that the dispositions of the advance ports 41*a* and the retard ports 41*b* are reversed and the dispositions of the advance communication holes 53*a* and the retard communication holes 53*b* are reversed.

The embodiments disclosed here can be used in a valve opening/closing timing control device which controls a relative rotation phase between a driving side rotator and a driven side rotator by a fluid pressure and holds the relative rotation phase at a predetermined phase by a lock mechanism.

A feature of an aspect of this disclosure resides in that a valve opening/closing timing control device includes: a driving side rotator which synchronously rotates with a crankshaft of an internal combustion engine; a driven side rotator which is coaxially disposed with a rotation axis of the driving side rotator and integrally rotates with a valve opening/closing camshaft; an advance chamber and a retard chamber which are formed between the driving side rotator and the driven side rotator; a lock mechanism which includes a lock member capable of engaging with a recessed portion formed on one of the driving side rotator and the driven side rotator and provided in the other of the driving side rotator and the driven side rotator; and a connecting bolt which is coaxially disposed with the rotation axis and connects the driven side rotator to the camshaft, in which the connecting bolt includes an internal space which is coaxially formed with the rotation axis, and an advance port communicating with the advance chamber, a retard port communicating with the retard chamber, and a lock port communicating with the recessed portion are formed as through-holes connecting the internal space and an outer periphery to each other, a valve unit is configured to accommodate a spool to be movable in a direction along the rotation axis in the internal space of the connecting bolt, and in the valve unit, the spool includes an internal flow path through which a fluid is supplied about the rotation axis, and a lock drain flow path through which a fluid is discharged from the lock port and a phase control drain flow path through which a fluid is discharged from the advance chamber or the retard chamber are formed to be flow paths different from each other.

According to this configuration, in a case where the spool is set to a position at which the fluid is discharged from the lock port, the fluid is discharged via the lock drain flow path. The lock drain flow path is a flow path which is different from the phase control drain flow path through which the fluid is discharged from the advance chamber or the retard chamber, and thus, the fluid discharged from the lock drain flow path is not combined with the fluid discharged from the advance chamber or the retard chamber, and the fluid can be discharged without suppressing the flow in the lock drain flow path.

Accordingly, the valve opening/closing timing control device is configured, in which the lock mechanism is rapidly and reliably shifted to the locked state while the control of the relative rotation phase and the control of the lock mechanism are performed by controlling the fluid using the single spool.

As another configuration, a position at which the spool is pushed most in the direction along the rotation axis may be set to a lock position at which the fluid from the lock port is discharged, and the lock drain flow path may be formed in a region in which the fluid from the lock port at the lock position is discharged from an outer end position of the spool.

According to this configuration, in the case where the spool is set to the lock position at which the spool is pushed most, the fluid can be discharged from the outer end position of the spool to the lock drain flow path. Accordingly, it is not necessary to form the spool into a groove shape or a hole shape for forming the lock drain flow path, and thus, the configuration of the valve opening/closing timing control device is simple, and the manufacturing thereof is easy.

As another configuration, a sleeve may be disposed between an inner surface of the connecting bolt and an outer surface of the spool, and the lock drain flow path and the phase control drain flow path are formed at a boundary between the inner surface of the connecting bolt and the outer surface of the sleeve.

According to this configuration, for example, it is possible to form the lock drain flow path and the phase control drain flow path by only forming a groove on the inner surface of the connecting bolt or a groove on the outer surface of the sleeve, and for example, compared to a case where the lock drain flow path or the phase control drain flow path is formed by a through-hole, it is easy to manufacture the valve opening/closing timing control device.

As another configuration, an advance flow path may be formed between the advance chamber and the advance port, a retard flow path may be formed between the retard chamber and the retard port, a lock control flow path may be formed between the lock port and the recessed portion, and a flow path cross-sectional area of the lock control flow path may be set to be larger than any one of a flow path cross-sectional area of the advance flow path and a flow path cross-sectional area of the retard flow path.

According to this configuration, the flow path cross-sectional area of the lock control flow path is larger than the flow path cross-sectional area of the advance flow path and the flow path cross-sectional area of the retard flow path. Accordingly, when the fluid is discharged from the lock control flow path, a resistance of the flow path decreases, and shifting to a locked state can be more rapidly performed.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A valve opening/closing timing control device comprising:

a driving side rotator which synchronously rotates with a crankshaft of an internal combustion engine;

a driven side rotator which is coaxially disposed with a rotation axis of the driving side rotator and integrally rotates with a valve opening/closing camshaft;

an advance chamber and a retard chamber which are formed between the driving side rotator and the driven side rotator;

a lock mechanism which includes a lock member capable of engaging with a recessed portion formed on one of the driving side rotator and the driven side rotator and provided in the other of the driving side rotator and the driven side rotator; and a connecting bolt which is coaxially disposed with the rotation axis and connects the driven side rotator to the camshaft, wherein the connecting bolt includes an internal space which is coaxially formed with the rotation axis, and an advance port communicating with the advance chamber, a retard port communicating with the retard chamber, and a lock port communicating with the recessed portion are formed as through-holes connecting the internal space and an outer periphery to each other, a valve unit in the internal space of the connecting bolt, the valve unit including a spool accommodated to be movable in a direction along the rotation axis, and in the valve unit, the spool includes an internal flow path through which a fluid is supplied about the rotation axis, a lock drain flow path through which a fluid is discharged from the lock port to outside the valve unit, and a phase control drain flow path through which a fluid is discharged from the advance port or the retard port to outside the valve unit, and the internal flow path, the lock drain flow path, and the phase control flow path are formed to be flow paths different from each other throughout the spool.

2. The valve opening/closing timing control device according to claim 1, wherein a position at which the spool is pushed most in the direction along the rotation axis is set to a lock position at which the fluid from the lock port is discharged, and the lock drain flow path is formed in a region in which the fluid from the lock port at the lock position is discharged from an outer end position of the spool.

3. The valve opening/closing timing control device according to claim 1, wherein a sleeve is disposed between an inner surface of the connecting bolt and an outer surface of the spool, and the lock drain flow path and the phase control drain flow path are formed at a boundary between the inner surface of the connecting bolt and the outer surface of the sleeve.

4. The valve opening/closing timing control device according to claim 2, wherein a sleeve is disposed between an inner surface of the connecting bolt and an outer surface of the spool, and the lock drain flow path and the phase control drain flow path are formed at a boundary between the inner surface of the connecting bolt and the outer surface of the sleeve.

5. The valve opening/closing timing control device according to claim 1, wherein an advance flow path is formed between the advance chamber and the advance port, a retard flow path is formed between the retard chamber and the retard port, a lock control flow path is formed between the lock port and the recessed portion, and a flow path cross-sectional area of the lock control flow path is set to be larger than any one of a flow path cross-sectional area of the advance flow path and a flow path cross-sectional area of the retard flow path.

6. The valve opening/closing timing control device according to claim 2, wherein an advance flow path is formed between the advance chamber and the advance port, a retard flow path is formed between the retard chamber and the retard port, a lock control flow path is formed between the lock port and the recessed portion, and a flow path cross-sectional area of the lock control flow path is set to be larger than any one of a flow path cross-sectional area of the advance flow path and a flow path cross-sectional area of the retard flow path.

7. The valve opening/closing timing control device according to claim 3, wherein an advance flow path is formed between the advance chamber and the advance port, a retard flow path is formed between the retard chamber and the retard port, a lock control flow path is formed between the lock port and the recessed portion, and a flow path cross-sectional area of the lock control flow path is set to be larger than any one of a flow path cross-sectional area of the advance flow path and a flow path cross-sectional area of the retard flow path.

8. The valve opening/closing timing control device according to claim 4, wherein an advance flow path is formed between the advance chamber and the advance port, a retard flow path is formed between the retard chamber and the retard port, a lock control flow path is formed between the lock port and the recessed portion, and a flow path cross-sectional area of the lock control flow path is set to be larger than any one of a flow path cross-sectional area of the advance flow path and a flow path cross-sectional area of the retard flow path.

* * * * *